US010687587B2

(12) United States Patent
Tran

(10) Patent No.: US 10,687,587 B2
(45) Date of Patent: Jun. 23, 2020

(54) SCARF HOLDER

(71) Applicant: EOS Scarves, LLC, San Francisco, CA (US)

(72) Inventor: Jessicca Lee Tran, San Francisco, CA (US)

( * ) Notice: Subject to any disclaimer, the term of this patent is extended or adjusted under 35 U.S.C. 154(b) by 0 days.

(21) Appl. No.: 15/810,112

(22) Filed: Nov. 12, 2017

(65) Prior Publication Data

US 2018/0132569 A1 May 17, 2018

Related U.S. Application Data

(60) Provisional application No. 62/421,217, filed on Nov. 12, 2016.

(51) Int. Cl.
*A44B 6/00* (2006.01)

(52) U.S. Cl.
CPC ..... *A44B 6/00* (2013.01)

(58) Field of Classification Search
CPC ..... A44B 6/00
See application file for complete search history.

(56) References Cited

U.S. PATENT DOCUMENTS 1,262,093 A * 4/1918 Preston ..... A45D 8/00 132/275
2,042,807 A * 6/1936 Seebeck ..... A44B 6/00 24/66.2
2,488,954 A * 11/1949 Winters ..... A45D 8/34 132/275
4,035,873 A * 7/1977 Epperson ..... A41D 25/022 2/150
4,038,724 A * 8/1977 Parizek ..... A41D 25/022 2/207
4,106,123 A * 8/1978 Freedman ..... A41D 25/022 24/115 H
4,368,585 A * 1/1983 Meltzer ..... A47G 1/1646 40/661.05
5,054,128 A * 10/1991 Wimmer ..... A41F 3/02 2/246
5,709,013 A * 1/1998 Stanback ..... A44B 6/00 132/273
5,901,713 A * 5/1999 Mroczek ..... A45D 8/34 132/273
D443,724 S * 6/2001 Neary ..... D28/41
6,256,793 B1 * 7/2001 Arias ..... A41D 23/00 2/207
8,015,673 B2 * 9/2011 Rodman ..... A41D 25/022 2/150
2004/0237992 A1 * 12/2004 Klug ..... A45D 8/34 132/275

(Continued)

*Primary Examiner* — Robert Sandy
*Assistant Examiner* — David M Upchurch
(74) *Attorney, Agent, or Firm* — Roy L. Chan, A Professional Law Corporation; Roy L. Chan

(57) ABSTRACT

Various embodiments of a device to encircle and retain an article of fabric or clothing around a body part having at least one elongated loop formed of elastic material; at least one decorative plate having a front, back, and side; and at least one curved retainer hoop is integrated into the back of each of the at least one decorative plates in which the elastic material of the holder has been passed there through to retain the decorative plate to the retainer hoops.

10 Claims, 10 Drawing Sheets

(56) References Cited

U.S. PATENT DOCUMENTS

| | | | | |
|---|---|---|---|---|
| 2005/0071956 | A1* | 4/2005 | Fuller | A45C 15/00 24/17 B |
| 2005/0109361 | A1* | 5/2005 | Klug | A45D 8/34 132/275 |
| 2009/0065016 | A1* | 3/2009 | De Aguero | A45D 8/36 132/200 |
| 2015/0050433 | A1* | 2/2015 | Murray | D04D 7/10 428/5 |
| 2018/0000176 | A1* | 1/2018 | Venturi | A41D 25/025 |

* cited by examiner

SCARF HOLDER

CROSS-REFERENCE TO RELATED APPLICATIONS

The present application claims priority to provisional U.S. patent application Ser. No. 62/421,217, filed Nov. 12, 2016, and entitled "Scarf Holder," the disclosure of which is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to clothing accessories that keep an article of clothing, for example a section of fabric, a scarf, or a neckerchief, secured around a body part. The present invention further encompasses a decorative enhancement, which effectively and dramatically alters the look of an article of clothing on which it is utilized. The present invention also easily accommodates to users with physical challenges such as arthritis. The present invention allows the user different ways to style their scarf.

Articles of clothing that are used for warmth or adornment may be lost by wind, knot slippage, and movements made by the person who wears the article of clothing. Such articles of clothing, for example, those that can serve as scarves and neckerchiefs, can be retained through the use of knots, pins, clips, and other means. The means of retaining the article of clothing can also offer a decorative look or enhancement.

Many wearers choose to tie a knot to hold a scarf or neckerchief in position. In order to prevent slippage and loss, such articles of clothing also can be tied or restrained by the use of pins or clips. However, tying, pinning, and clipping scarves and neckerchiefs can damage the materials of which they are made by torsion, pins holes, and abrasion. Knots, pins, and clips can also move through gravity or wearer movements causing the wearer to lose the desired retention of the scarf or neckerchief.

The present invention overcomes the inadequacies of currently available scarf retainers, pins, and tying methods by avoiding holes, abrasion, and knots in the fabrics in which the device is used. The present invention also incorporates an elastic component which can be stretched to accommodate various thinness and thickness of scarf or neckerchief. The present invention further provides an easily employed method to retain a scarf for users who have physical challenges for example, those who suffer from arthritis and carpal tunnel syndrome.

The present invention additionally provides a means to display a decorative enhancement or ornamentation on the article of clothing on which it is employed. The present invention further allows ease of adjustment and re-positioning to ensure that the decorative enhancement is displayed in a desired orientation. The present invention allows the user different ways to style their scarf.

Previous attempts to create scarf holder devices include that disclosed in Parizek, et al., U.S. Pat. No. 4,038,724.

Parizek, et al discloses a scarf retainer that grips a scarf by friction using a pendant with rings attached to the rear side of the pendant. However, that device employs no elastic elements and the scarf must be carefully and tightly threaded so that the rings may grip the scarf. The resultant pinching effect can damage a scarf or an article of clothing. The device of Parizek, et al. also requires a retained scarf to be carefully unthreaded to be re-positioned.

The present invention uses elastic material for a strong functional grip that produces optimal friction in the fabric to be retained. The present invention further integrates a multitude of smooth beads, natural stones, or synthetic stones in which bores have been formed to pass through the elastic loops. The beads or stones thus surround the elastic. The use of the beads or stones imparts ease of manual grip and deployment, ease of device repositioning, and flexible re-orientation of a large decorative element or jewel. The beads or stones also induce minimal abrasion on the fabric or the piece of material that is to be retained. The elastic material allows for various thinness and thickness of fabric. The present invention allows the user to wear their scarf in different styles.

The device disclosed in Haar, et al., U.S. Pat. No. 7,174,901, provides a ponytail hair holder that employs an elastic element that is a single length of elastic material to surround and a restrain the ponytail using friction. The elastic material is looped around the ponytail and the ends of the elastic material are threaded through a bead in which a bore is formed there through to pinch the elastic and, through friction, restrain the ponytail. The device of Haar, et al. may be used also to restrain a scarf. However, that device again is difficult to deploy and re-position. It allows a scarf or piece of material to be worn or positioned only in one way. The Haar, et al. device also can cause friction-induced damage in the material which it retains. The elastic material of the present invention allows for various thinness and thickness of fabric. The present invention allows the user to wear their scarf in different styles.

Another device, disclosed in Stanback, U.S. Pat. No. 5,709,013, a flexible flat circular or oval base having bores in its flat surface through which elastic members are passed. The elastic members are used to retain a scarf. A decorative ornament having an integrated pin may be attached to the flat circular or oval base by passing the pin through bores in the base. The device again does not allow ease of deployment or re-positioning. The Stanback device also does not allow ease or flexibility of orientation in the display of the decorative ornament.

The orientation of the elastic loops of the present invention and use of beads or stones provides low stress on the fabric on which it is used. The present invention further allows ease of re-positioning using one hand to adjust the retention of an article of clothing. It also allows ease of re-adjustment of the display orientation of decorative elements incorporated into the device. This is accomplished by the orientation of elastic loops which allow the contractive force of the elastic to grip the material to be retained and yet slidably move through the beads or stones and also move slightly and slidably through the decorative element or plate attachment points. The elastic material allows for various thinness and thickness of fabric. The present invention allows the user to wear their scarf in different styles.

BRIEF SUMMARY OF THE INVENTION

An embodiment of the present invention is a device to encircle and retain an article of fabric or clothing around a body part comprising at least one elongated loop formed of elastic material; at least one decorative plate having a front, back, and side; and at least one curved retainer hoop is integrated into the back of each of the at least one decorative plates in which the elastic material of the holder has been passed there through to retain the decorative plate to the retainer hoops.

In another embodiment of the present invention, the at least one loop of elastic material is surrounded at least partially around its circumference and length by decorative stones or beadlike elements wherein the stones or bead-like elements have holes formed there through to pass the elastic material through.

In yet another embodiment of the present invention, the at least one retainer hoop is further comprised of a rigid material.

In another embodiment of the present invention, the at least one retainer hoop is comprised of a plurality of wire segments, the segments being fixedly mounted in spaced relationship, one to another, to the back side of the decorative plate at right angles thereto, each segment when mounted to the decorative plate forms, respectively, a closed loop, the segments being mounted to form two parallel adjacent loops whereupon the at least one loop of elastic material may be retained by the loops when the elastic material has been passed there through.

In yet another embodiment of the present invention, the at least one retainer hoop is further comprised of an elastic material.

In another embodiment of the present invention, the at least one retainer hoop is comprised of a smooth surfaced elastic material to allow the elastic material to move in a slidable manner to allow constant tension between the beads and elastic.

In yet another embodiment of the present invention, the at least one loop of elastic material is two loops of elastic material and further wherein there are at least two retainer hoops affixed to the back of each of the at least one decorative plates to retain each loop of elastic material.

In another embodiment of the present invention, the at least one curved retainer hoop is integrated into the decorative plate by being affixed to the decorative plate.

In yet another embodiment of the present invention, the at least one curved retainer hoop is integrated into the decorative plate by being a circle of material defining a bore which has been formed through the side of the decorative plate.

BRIEF DESCRIPTION OF THE SEVERAL VIEWS OF THE DRAWING

The advantages and features of the present invention will be better understood as the following description is read in conjunction with the accompanying drawings, wherein.

DETAILED DESCRIPTION OF THE INVENTION

The following description is considered to be illustrative of the principles of the present invention and is not intended to be limiting. One of skill in the art will recognize and understand that there are suitable modifications and equivalents that may be used which fall within the scope of the invention described herein.

Figure 1:
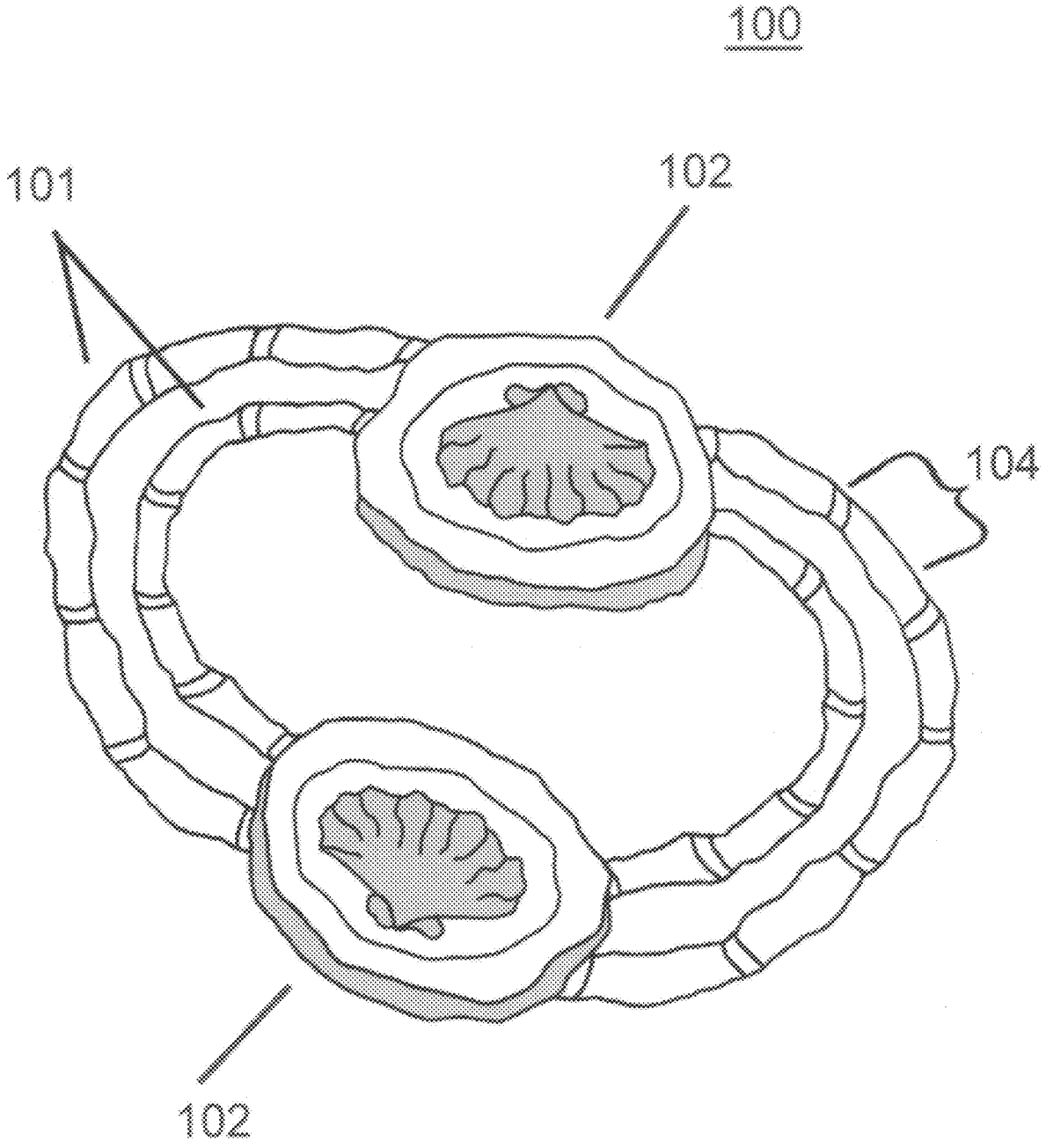
FIG. 1 illustrates a view of a first embodiment of a holder of the invention which shows the top of a decorative plate of the invention.

Referring to FIG. 1 a first example embodiment of the present invention, 100, is shown representatively from the top having two elongated elastic loops, 101, and two decorative plates, 102, each plate having a front, back, and side.

In a first example embodiment of the present invention 100, the device has at least one loop of elastic material surrounded at least partially around its circumference and length by decorative beads 104, which are decorative stones or bead-like elements wherein the decorative beads 104, have holes formed there through to pass the elastic material through.

Figure 2:
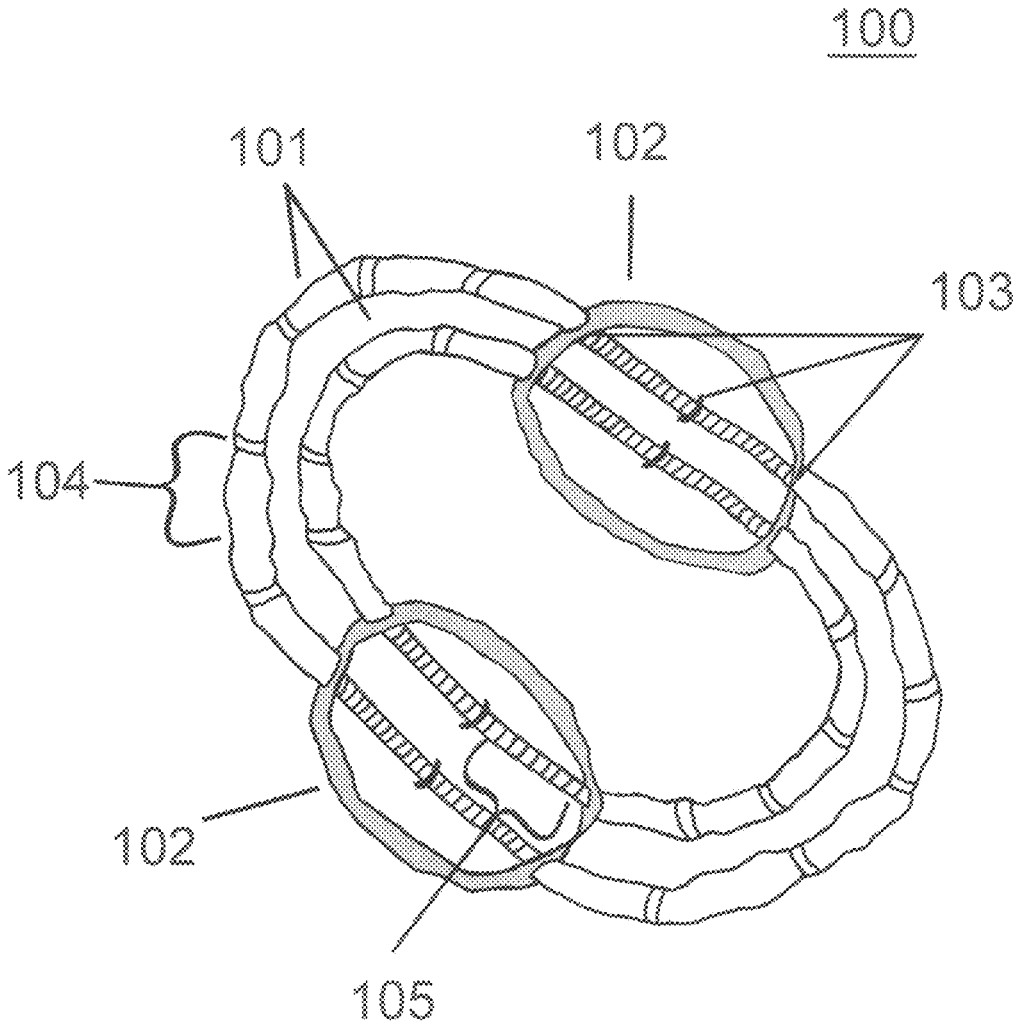
FIG. 2 is a view of the first embodiment of a holder of the invention which shows the back of the decorative plate illustrated in FIG. 1.

FIG. 2 shows the same embodiment of the device 100, as in FIG. 1 from a view of the back of the decorative plates, 102. In FIG. 2, one can see that each decorative plate has parallel hoops which comprise a set of retainer hoops, 103 through which is passed one elastic loop. The decorative plate 102, as shown has two sets of three parallel retainer hoops 103. There are large decorative beads, 104, and smaller structural beads, 105 shown at the section at the back of the decorative plate. Continuous contact between all beads or between the beads and the retainer hoops allows the beads to be physically positioned against each other or the decorative plate. This mated or continuous contact creates a physical resistance which provides the ability to stretch the elastic material that comprises the elastic loops 101, slightly before fitting it in place through the retainer hoops during manufacturing the present invention. This continuous contact maintains the order of the beads and allows a tight fitting nature to facilitate tension between the beads and the elastic and thus allow ease of grip, stretching and re-positioning of the present invention. The elastic is slightly slidable or movable through the beads or stones so that the combination of elastic tension and adjustment and the slidable nature of the elastic through the retainer hoops provides readily deployed and released torque and tension that can be exploited to allow easy re-positioning of the device if the user desires to move the device.

The retainer hoops may consist of a curved loop, semi-circle, or circle of a rigid or semi-rigid material that is affixed to the decorative plate 102. Alternatively, the retainer hoops may consist of a semicircle or circle which defines an orifice and which is formed as a bore through the side of the decorative plate 102. The elastic material of the elastic loop 101 has been passed through the retainer hoops 103, to retain the decorative plate 102.

The device 100, may also have the retainer hoops comprised of a plurality of wire segments, the segments being fixedly mounted in spaced relationship, one to another, to the back side of the decorative plate at right angles thereto, each segment when mounted to the decorative plate forms, respectively, a closed loop, the segments being mounted to form two parallel adjacent loops whereupon the at least one loop of elastic material may be retained by the loops when the elastic material has been passed there through.

The device of 100 may alternatively have at least one retainer hoop comprised of an elastic material. This will allow desired increased torque, tension, and ease of re-positioning.

Alternatively, it may, therefore, be advantageous to ensure that the retainer hoop 103, if comprised of an elastic material, allows the elastic loop to slide as necessary for deployment. This can include having the retainer hoop 103, being comprised of a smooth surfaced elastic material to allow the elastic loop to move in a slidable manner to allow constant tension between the beads and elastic and yet allow ease of re-positioning the decorative plate 102.

To allow enhanced holding power and ease of re-positioning, the device, 100, may have two loops of elastic material 101. Further, there can be at least two retainer hoops 103, affixed to the back of each of the at least one decorative plates 102, to retain each loop of elastic material 101.

Figure 3:
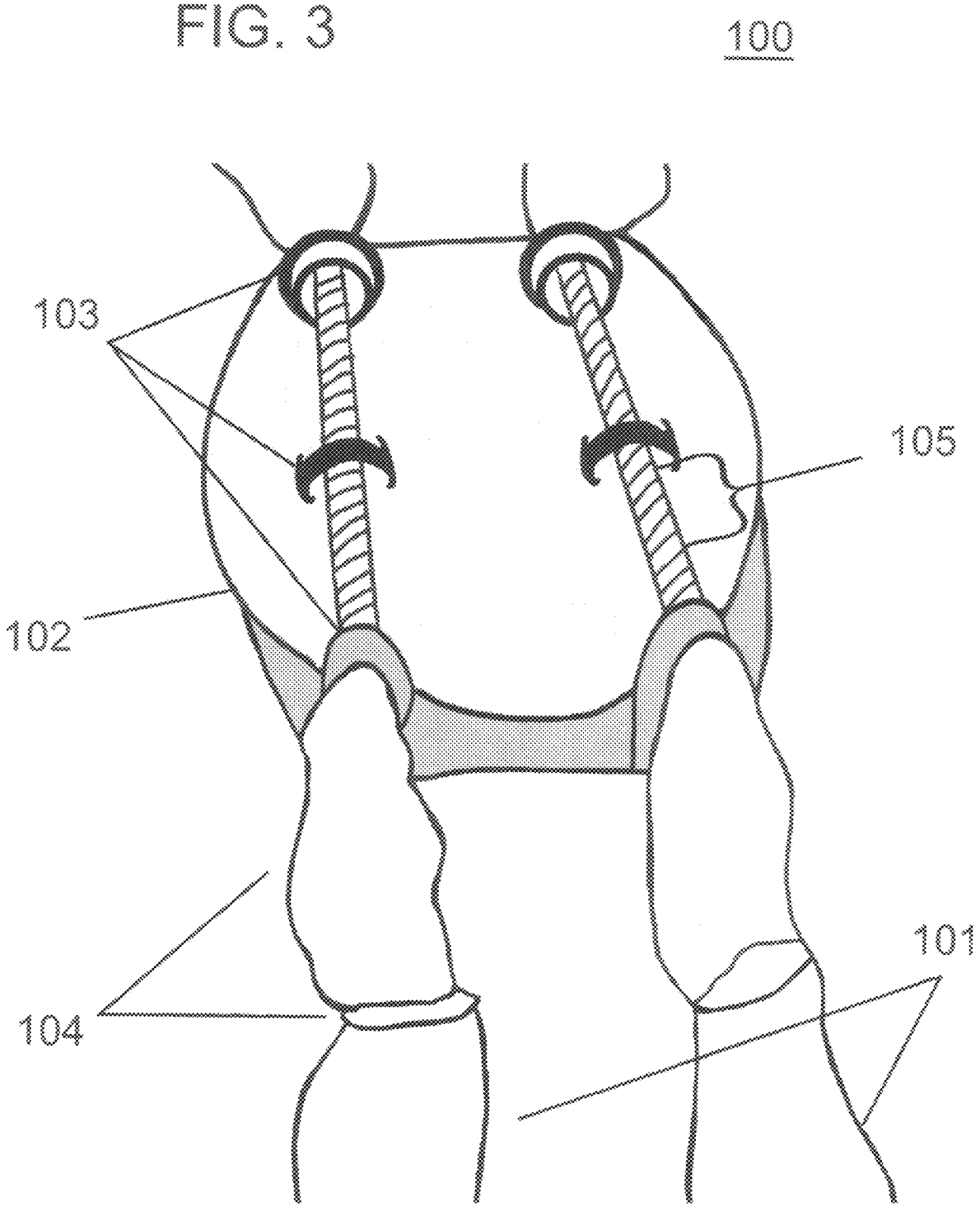
FIG. 3 is a view of the first embodiment of a holder of the invention which shows a side view of the decorative plate illustrated in FIG. 1.

FIG. 3 shows an enlarged side view of the device 100, showing the elastic loops 101, the back of the decorative plate 102, the retainer hoops 103 which are comprised of both a semicircle of material affixed to the back of the decorative plate 102, and also bores in the sides of the decorative plate 102, decorative beads, 104, and how the elastic material of the elastic loops 101 is positioned through the retainer hoops, 103 at the back of the decorative plates.

Figure 4:
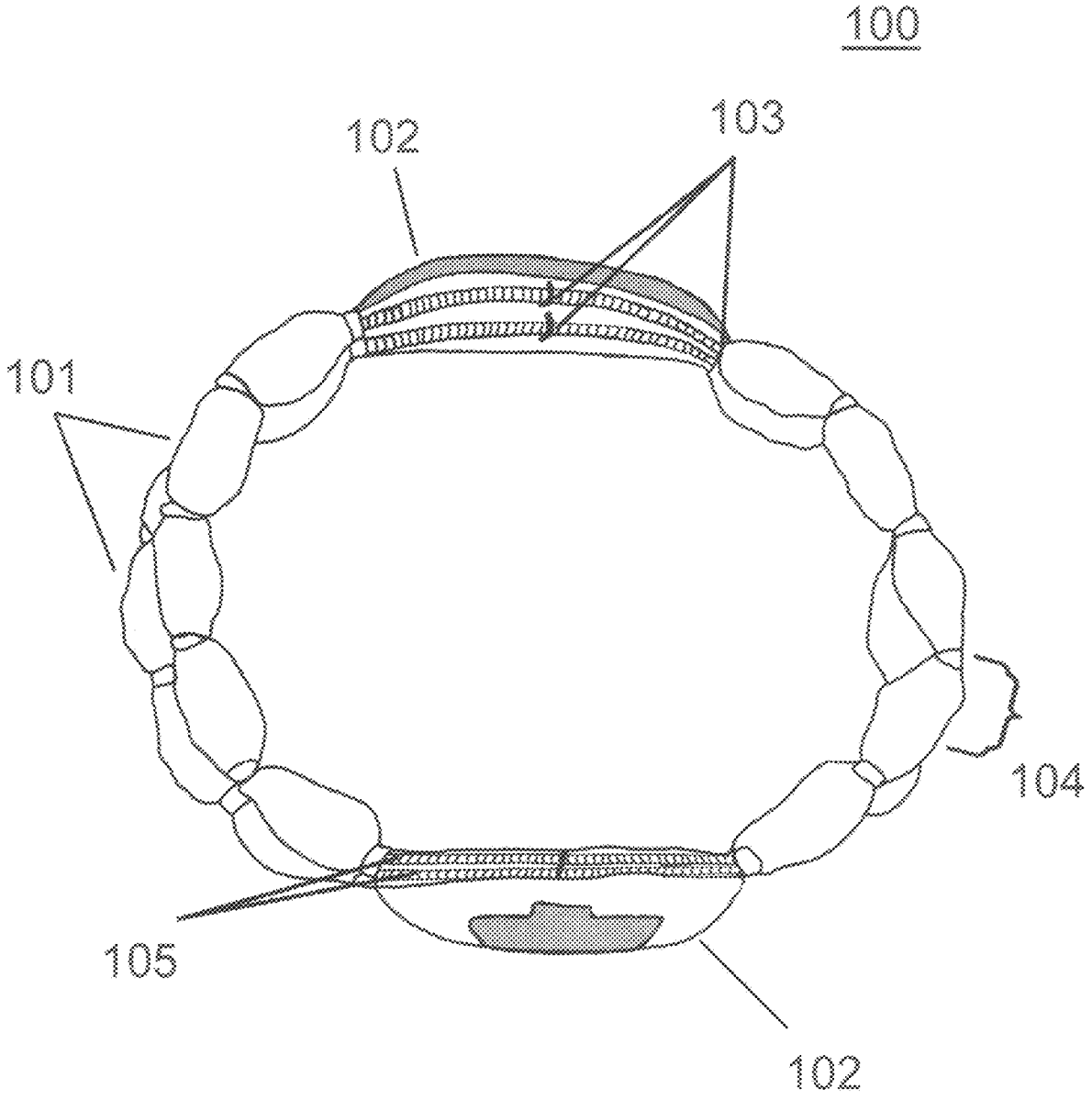
FIG. 4 illustrates a view of the first embodiment of a holder of the invention which shows the top of a decorative plate illustrated in FIG. 1.

FIG. 4 shows a side view of the device 100, showing the elastic loops 101, the side of the decorative plate 102, the retainer hoops 103, which are comprised of both a semicircle of material affixed to the back of the decorative plate 102, and also bores in the sides of the decorative plate 102, decorative beads, 104, and how the elastic material of the elastic loops 101 is positioned through the retainer hoops, 103 at the back of the decorative plates.

Figure 5:
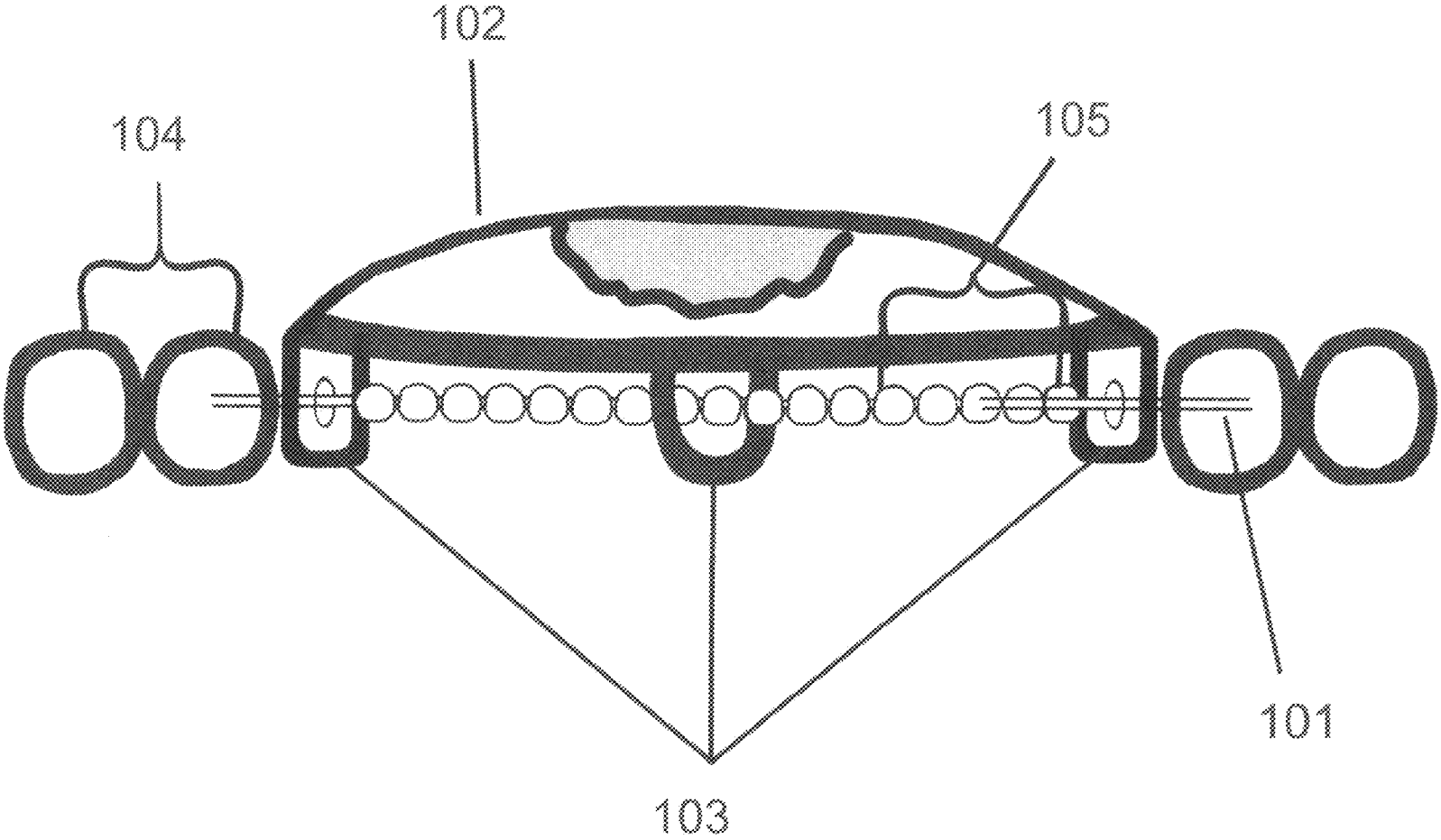
FIG. 5 is a view of the first embodiment of a holder of the invention which shows the side of the decorative plate illustrated in FIG. 1.

FIG. 5 shows a side view of the device 100, showing the side of the decorative plate 102, the retainer hoops 103, which are comprised of both a semicircle of material affixed to the back of the decorative plate 102, and also bores in the sides of the decorative plate 102, decorative beads, 104, structural beads 105, and how the elastic material of the elastic loops 101, is positioned through the decorative beads 104, the retainer hoops 103, and also through the structural beads 105, at the back of the decorative plates.

Figure 6:
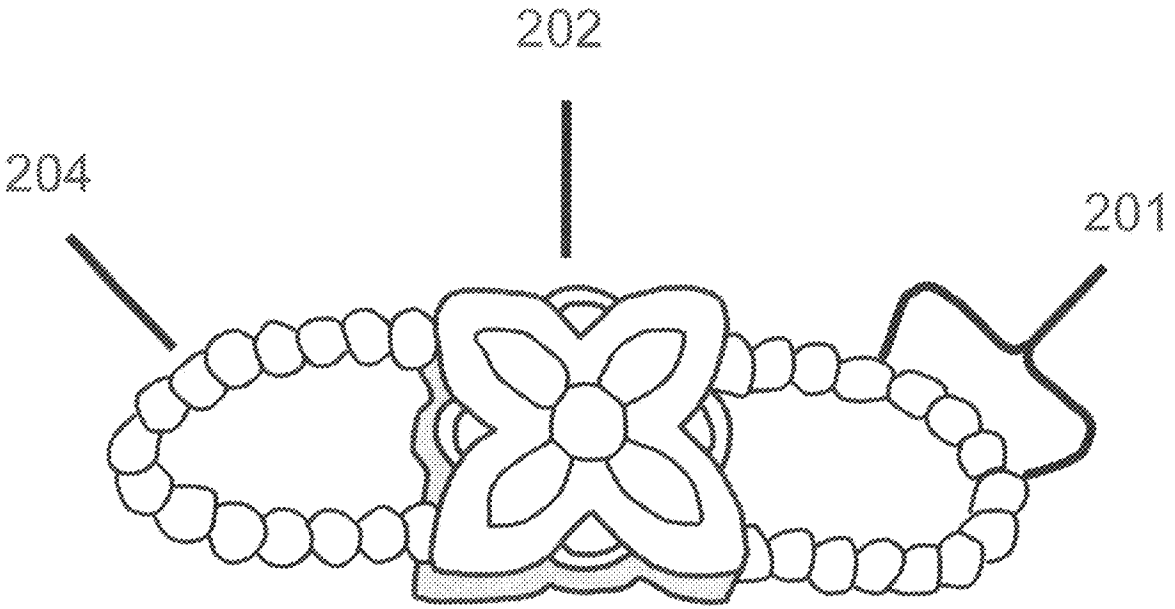
FIG. 6 is a view of a second embodiment of a holder of the invention which shows the top view of a decorative plate of the invention.

FIG. 6 is a second embodiment of the invention 200, which shows the device having one continuous elastic loop 201, a decorative plate 202, and decorative beads 204.

Figure 7:
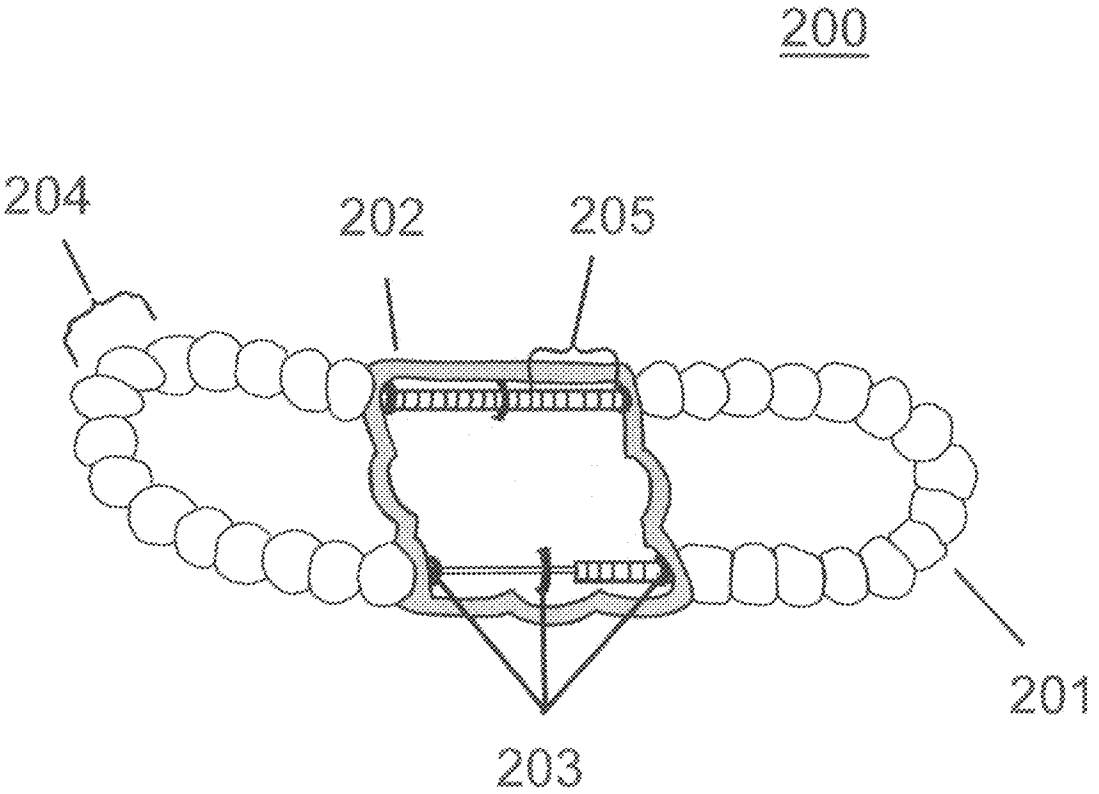
FIG. 7 is a bottom view of the second embodiment of a holder of the invention which shows the back of the decorative plate illustrated in FIG. 6.

FIG. 7 shows a second embodiment of the invention 200, from the back of the decorative plate, 202. The elastic loop 201, is shown passed through the decorative beads 204, passed through the structural beads 205, and through the retainer hoops 203, at the back of the decorative plate 202. The retainer hoops 203, are shown to be comprised of both a semicircle of material affixed to the back of the decorative plate 202, and also bores in the sides of the decorative plate 202.

Figure 8:
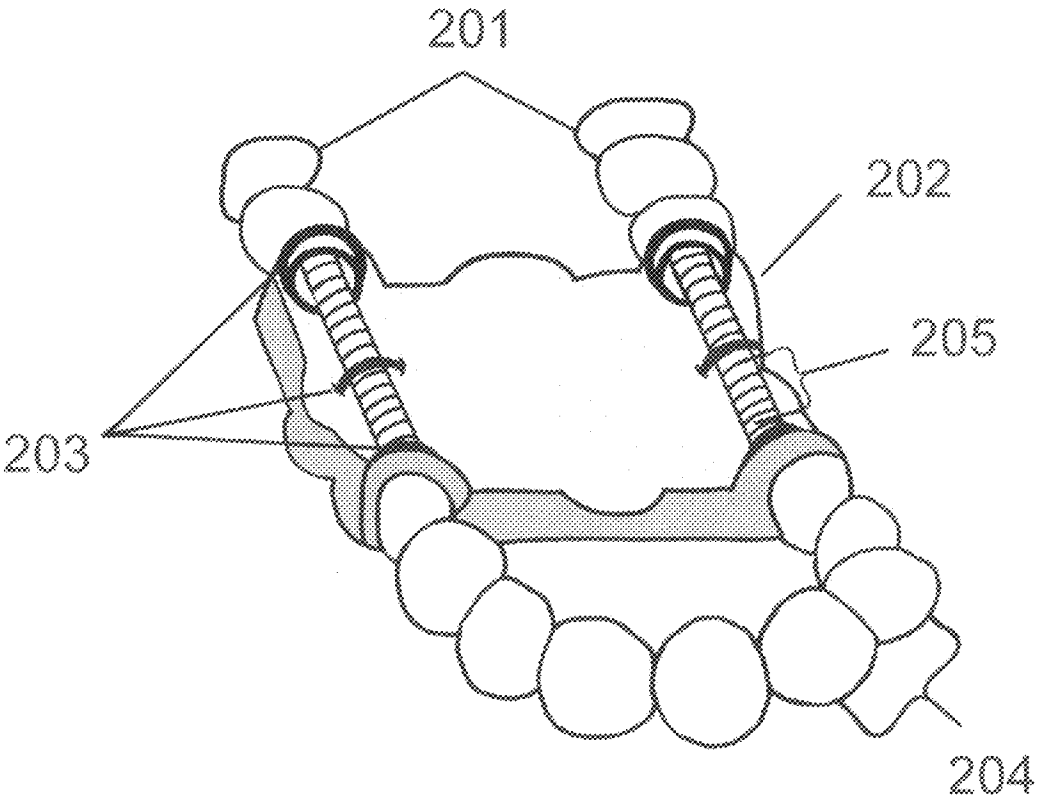
FIG. 8 is a side view of the second embodiment of a holder of the invention which shows the back of the decorative plate illustrated in FIG. 6.

FIG. 8 shows an enlarged side view of the device 200, showing the elastic loops 201, the back of the decorative plate 202, the retainer hoops 203 which are comprised of both a semicircle of material affixed to the back of the decorative plate 202, and also bores in the sides of the decorative plate 202, decorative beads, 204, and how the elastic material of the elastic loop 201, is positioned through the retainer hoops, 203 at the back of the decorative plates.

Figure 9:
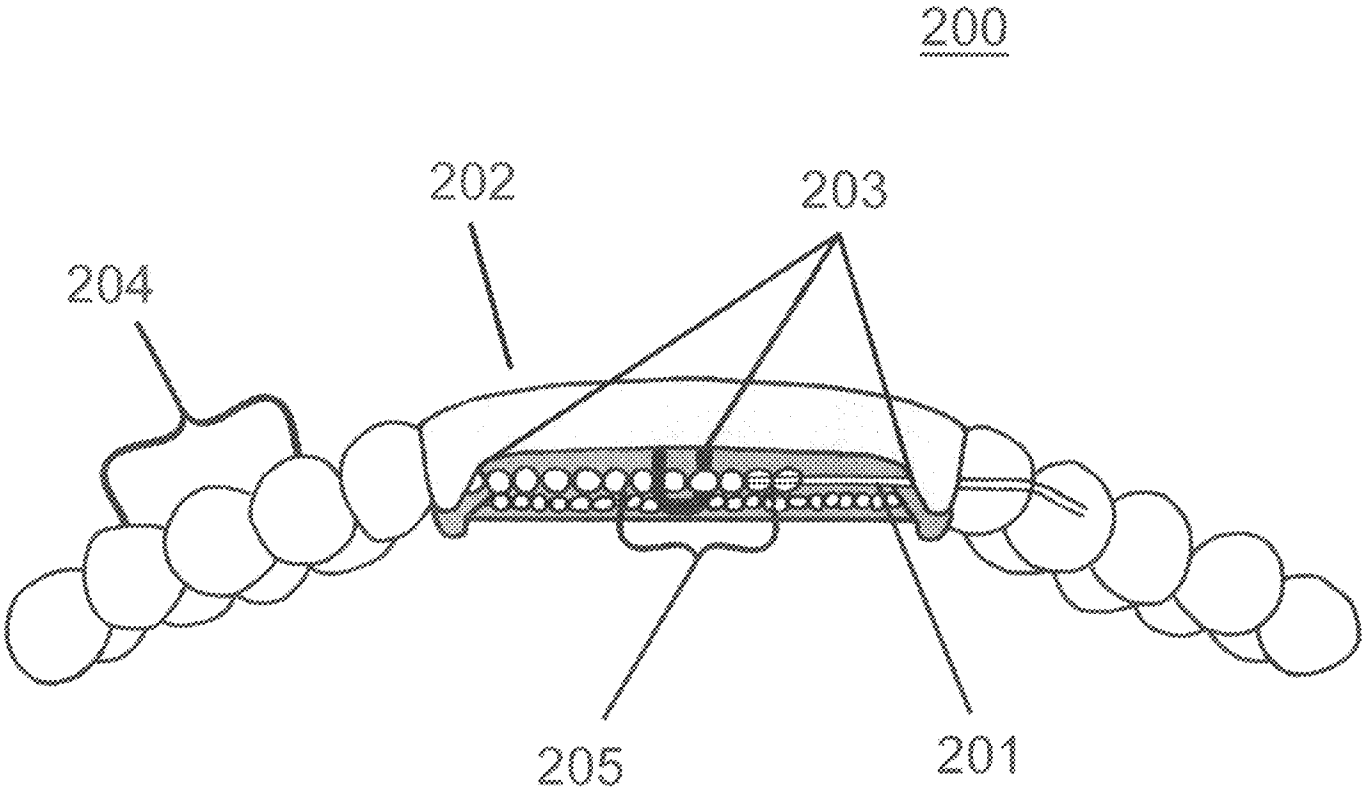
FIG. 9 is a side view of the second embodiment of a holder of the invention which shows the back of the decorative plate illustrated in FIG. 6.

FIG. 9 is another side view of the device 200, showing the side of the decorative plate 202, the retainer hoops 203, which are comprised of both a semicircle of material affixed to the back of the decorative plate 202, and also bores in the sides of the decorative plate 202, decorative beads, 204, structural beads 205, and how the elastic material of the elastic loop 201, is positioned through the decorative beads 204, the retainer hoops 203, and also through the structural beads 205, at the back of the decorative plates.

Figure 10:
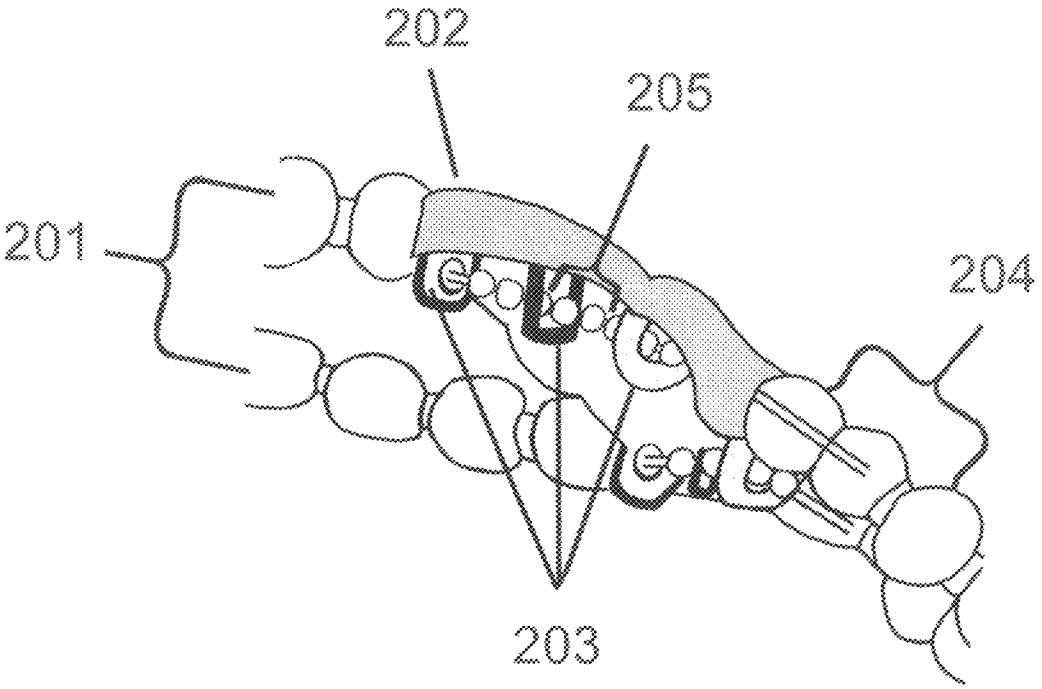
FIG. 10 is a side view of the second embodiment of a holder of the invention which shows the back of the decorative plate illustrated in FIG. 6.

FIG. 10 is an enlarged side view of the device 200, showing the side of the decorative plate 202, the retainer hoops 203, which are comprised of both a semicircle of material affixed to the back of the decorative plate 202, and also bores in the sides of the decorative plate 202, decorative beads, 204, structural beads 205, and how the elastic material of the elastic loop 201, is positioned through the decorative beads 204, the retainer hoops 203, and also through the structural beads 205, at the back of the decorative plates.

Increased or decreased elasticity is conferred to the loops of elastic material by using materials that can be stretched and then which return to most of their previous shape and size.

The loops may be composed of any sort of elastic materials that is suitable for use as a clothing accessory. For example, such elastic materials may be chosen from both natural and man-made or synthetic materials. Examples of natural materials include latex or rubber. Examples of man-made or synthetic elastic materials include polymers of hydrocarbons including acrylonitrile, elastane, nylon, polyamide, polyester, spandex, styrene, and thermoplastic polyurethane (TPU), polysiloxanes, such as silicone.

The ends of the elastic material may be formed or joined into a loop by tying the ends of a linear segment of the elastic material together in a knot, which knots may be hidden with a structural or decorative bead. The elastic loop may alternatively be formed by gluing the ends of the elastic material together, melting the ends together, annealing the ends together, for example, through the use of solvents to temporarily soften the two ends of the material, pressing them together, and allowing the two ends to re-anneal or dry together. The elastic loop ends can also be joined by using clips to joins them together, using jewelry end caps to join them, or crimping them together, for example, by using crimping means such as crimp beads, crimp covers, or crimp tube. The elastic material may also be joined into a loop through the use of a cap and plug type design. In the cap and plug type design, one end of a linear section of the elastic material has a cup shaped cap and the opposite end of the linear segment has a plug shaped end which plug is inserted into the cap to join the ends to form a loop.

The beads or stones having holes formed there through which are used in the present device are large enough to allow the elastic portion of the device to be gripped and re-positioned by using the fingers to stretch the elastic members. Stretching the elastic members may also be accomplished using one hand.

It should be noted that the embodiments disclosed are exemplary and are not intended to be an exhaustive disclosure of all possible embodiments of the present invention. One skilled in the art of designing or manufacturing scarf holders will understand that there are alternatives and combinations for the invention based on the features and disclosure provided herein.

Example 1

How to Make the Present Invention

Scarf holder style A is for all scarves, neckerchiefs and the likes.

Pre-stretch 10 inches of 0.07 mm to 1 mm thick jewelry elastic cord, thermoplastic polyurethane (TPU) cord, or stretch cord, for example, STRETCH MAGIC from Pepperell Braiding Company, 22 Lowell Street, Pepperell, Mass. 01463 USA. Pre-stretching helps keep the cord from stretching later and losing its shape.

Scarf holder can have all beads of similar size or different sizes. The structural beads are used to cover the elastic material in the elastic loop behind the decorative plate. The decorative beads may be used to adorn and add an easily graspable surface while hiding the elastic material of the elastic loop. The decorative beads may be positioned on the segments of the elastic loop that are exposed outside of the decorative plate.

It is best to select beads with a bore that has large enough and smooth holes to avoid cutting or wearing away the elastic material in the elastic loop.

Depending on the design, the scarf holder can consist of singular or multiple strands of beads. For multiple strands design, any size beads will work. For one strand design, it is best to select beads larger than 8 mm so it will show around the fabric and have the needed strength and support.

Example 2

An Alternative Method to Make the Present Invention

Scarf B is for scarves under 22" square.

Pre-stretch 10 inches of 0.07 mm to 1 mm thick jewelry elastic cord, thermoplastic polyurethane (TPU) cord or stretch cord for example, Pepperell Braiding Company, 22 Lowell Street, Pepperell, Mass. 01463 USA. Pre-stretching helps keep the cord from stretching later and losing its shape.

Slip on the decorative plate, cover the cord with structural beads, exit the decorative plate, slip 2 inches of decorative beads, go through the other end of the decorative plate, cover cord with structural beads, exit the decorative plate, slip on 2 inches of decorative beads, enter through the decorative plate and tie ends.

Grab both ends and make an overhand knot. For extra security, grab the ends, make a surgeon knot, and add a dab of glue in the joint.

I claim:

1. A device to encircle and retain an article of fabric or clothing around a body part comprising:

at least one elongated loop formed of elastic material;

at least one decorative plate having a front, back, and side; and at least one pair of curved retainer hoop sets is integrated into the back of each of the at least one decorative plates in which the at least one elongated loop formed of elastic material has been passed there through to retain the decorative plate to the at least one curved retainer hoop;

wherein the at least one elongated loop formed of elastic material is surrounded around a circumference and a length of the at least one elongated loop formed of elastic material by decorative stones or beads wherein the stones or beads have holes formed there through to pass the at least one elongated loop formed of elastic material through; and, wherein each curved retainer hoop set comprises at least three hoops.

2. The device of claim 1 wherein the at least one curved retainer hoop is further comprised of a rigid material.

3. The device of claim 1 wherein the at least one curved retainer hoop is comprised of a plurality of wire segments, the segments being fixedly mounted in spaced relationship, one to another, to the back side of the decorative plate at right angles thereto, each segment when mounted to the decorative plate forms, respectively, a closed loop, the segments being mounted to form two parallel adjacent loops whereupon the at least one loop of elastic material may be retained by the loops when the elastic material has been passed there through.

4. The device of claim 1 wherein the at least one curved retainer hoop is further comprised of an elastic material.

5. The device of claim 4 wherein the at least one curved retainer hoop is comprised of a smooth surfaced elastic material to allow the elastic material to move in a slidable manner to allow constant tension between the stones or beads and the elastic material.

6. The device of claim 1 wherein the at least one loop of elastic material is two loops of elastic material and further wherein there are at least two curved retainer hoops affixed to the back of each of the at least one decorative plates to retain each loop of elastic material.

7. The device of claim 1 wherein the at least one curved retainer hoop is integrated into the decorative plate by being affixed to the decorative plate.

8. The device of claim 1 wherein the at least one curved retainer hoop is integrated into the decorative plate by being a circle of material defining a bore which has been formed through the side of the decorative plate.

9. The device of claim 1 wherein the three hoops are linearly aligned.

10. The device of claim 1 wherein each set of the at least one pair of curved retainer hoop sets is parallel to each other.

* * * * *